US005257172A

United States Patent [19]

Erickson

[11] Patent Number: 5,257,172

[45] Date of Patent: Oct. 26, 1993

[54] TROUBLE LIGHT

[76] Inventor: Clifford C. Erickson, 621 Prairie Ave., Janesville, Wis. 53545

[21] Appl. No.: 780,952

[22] Filed: Oct. 23, 1991

[51] Int. Cl.[5] ..... F21V 23/06

[52] U.S. Cl. ..... 362/226; 362/457

[58] Field of Search ..... 362/226, 326, 377, 378, 362/217, 260, 183, 457

[56] References Cited

U.S. PATENT DOCUMENTS

| | | | |
|---|---|---|---|
| 1,382,800 | 6/1921 | Purple | 362/376 |
| 2,710,338 | 6/1955 | Svalgaard | 362/108 |
| 4,298,919 | 11/1981 | Karasawa | 362/226 |
| 4,513,356 | 4/1985 | Mikola | 362/226 |
| 4,748,545 | 5/1988 | Schmitt | 362/226 |
| 4,822,302 | 4/1989 | Dorleans | 362/226 |
| 4,912,609 | 3/1990 | Gillette | 362/226 |

*Primary Examiner*—Richard R. Cole
*Attorney, Agent, or Firm*—Robert M. Wolters

[57] ABSTRACT

A trouble light is provided which has an insulating housing and male prongs extending from one end of the housing and shielded by an extension of the housing. There is no conventional wired-in drop cord on the trouble light. Instead, an extension cord has a female socket and the aforesaid prongs on the housing are plugged into the extension cord female socket. A flexible retainer strap interconnects with the extension and is anchored on projections on the housing to prevent inadvertent disconnection of the extension cord from the trouble light.

7 Claims, 2 Drawing Sheets

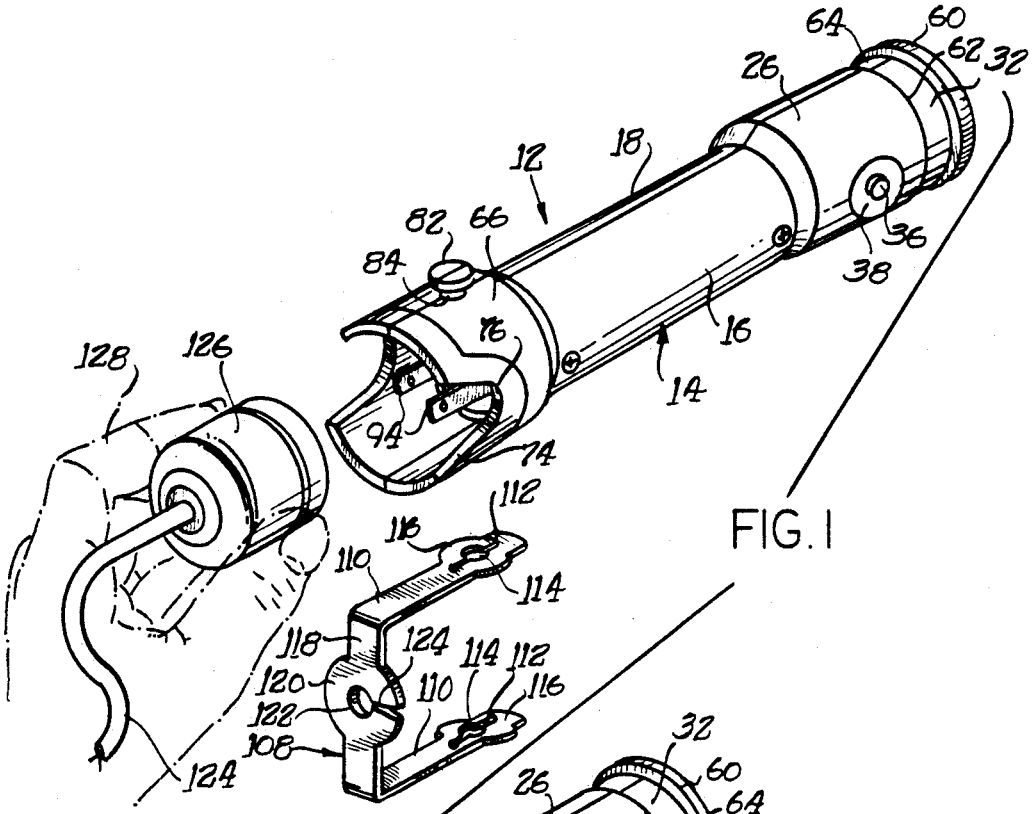
FIG. 1
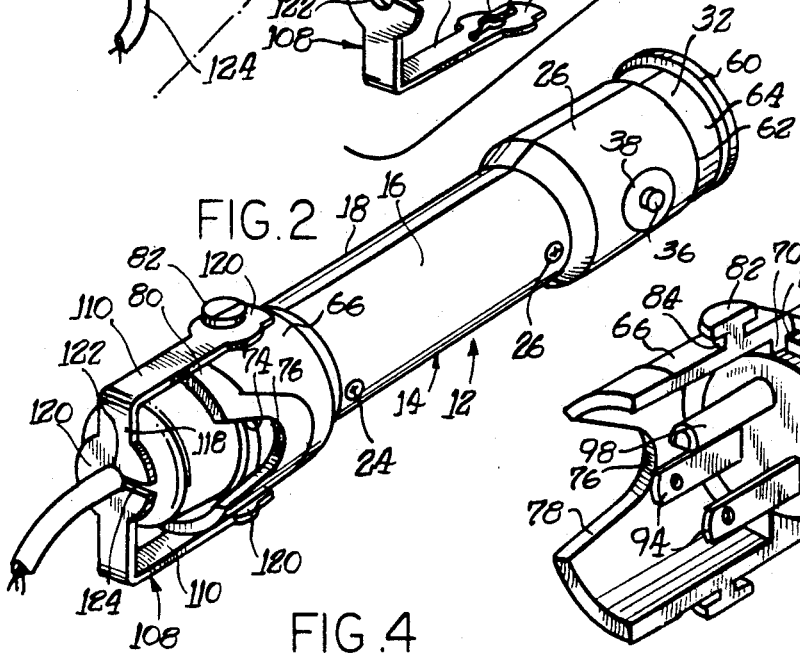
FIG. 2
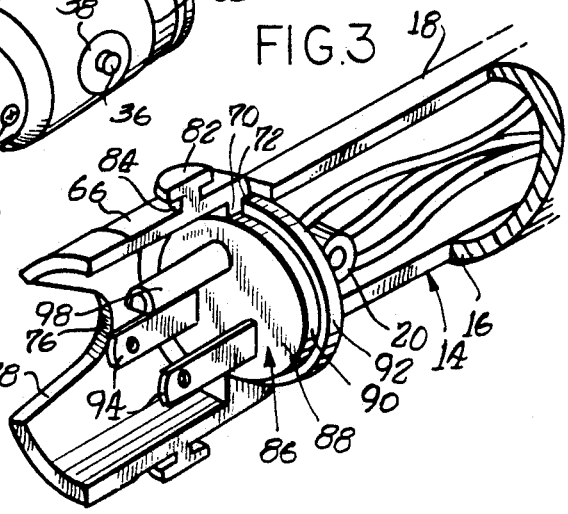
FIG. 3
FIG. 4
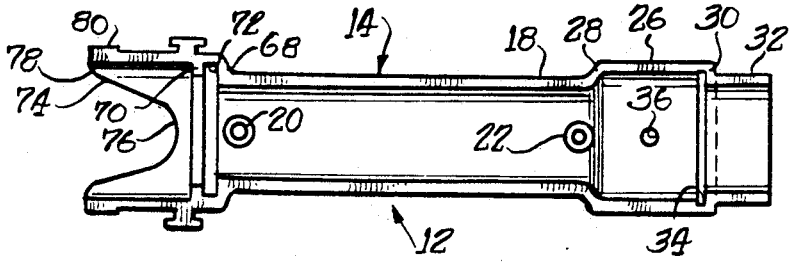

TROUBLE LIGHT

BACKGROUND OF THE INVENTION

Trouble lights are well known, and are used particularly in the automobile repair business. Such lights comprise a handle fixed to the end of an extension cord, and having a lamp socket at one end, usually with a reflector and shield or guard across the reflector and protecting the light bulb from damage. The long cord extending from the trouble light adds considerably to the cost, and makes it often prohibative for use in the home or by the home mechanic. Furthermore, it is usually the light itself, rather than the long cord, that limits the useful life of the trouble light. Unfortunately, using current practices it is necessary to throw the cord away with the remainder of the trouble light. It is not economically feasible to recycle the cord with a new light.

OBJECTS AND SUMMARY OF THE PRESENT INVENTION

It is an object of the present invention to provide a trouble light with a separable drop cord or extension core so that the lamp portion of the trouble light can be replaced simply on a plug-in basis with the drop cord or extension cord.

It is another object of the present invention to provide a trouble light with a separable drop cord or extension cord which is readily attached and detached from the lamp portion of the trouble light, yet which will not come loose accidentally.

It is yet another object of the present invention to provide a trouble light as in the preceeding objects which meets recognized standards of electrical safety.

In carrying out the foregoing and other objects of the present invention I provide a trouble light comprising a standard, grounded extension cord which may be provided as a portion of the trouble light, or which may be an extension cord the user already possesses. The trouble light includes a lamp portion having a handle which at one end carries a lamp socket and a switch and preferably a reflector and guard for a light bulb. At the other end the lamp portion is provided with standard male connecting pins or prongs which are shielded against accidental touching. The shielding portion is recessed to allow a thumb and finger to grasp the female socket of the extension cord for plugging in. Although the socket is readily assembled with or disassembled from the lamp portion a retainer strap prevents accidental disengagement thereof.

THE DRAWINGS

The present invention will best be understood from the following description when taken in connection with the accompanying drawings wherein:

FIG. 1 comprises a perspective view of the present invention with the female socket about to be plugged into the lamp portion of the trouble light;

FIG. 2 is a view similar to FIG. 1 but showing the socket associated with the plug portion and held in place by a retainer strap.

FIG. 3 is an enlarged perspective view of the plug end portion of the lamp, with a portion of the lamp housing broken away to show individual parts thereof;

FIG. 4 is a side view of one-half of the lamp housing;

DETAILED DESCRIPTION OF THE ILLUSTRATED EMBODIMENTS

Figure 5:
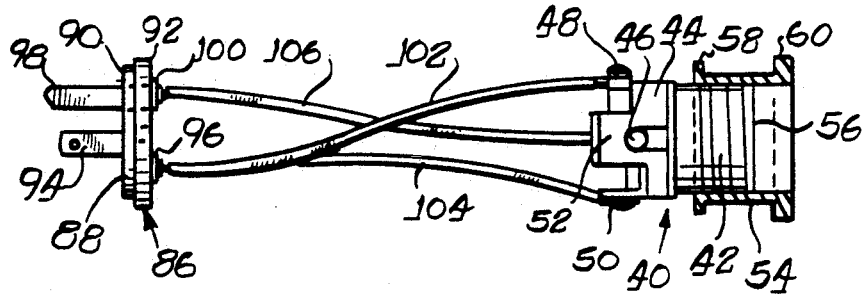
FIG. 5 is a side view of the electrical portion of the lamp, namely the plug or prongs, the female lamp socket, and the interconnecting wiring.

Referring first to FIGS. 1–4, there is shown a trouble light or hand lamp 12. The trouble light includes a central handle or band gripping portion 14. The trouble light is molded of a suitable insulating resinous plastic material, and includes a right half 16 and a left half 18, the two halfs being substantially mirror images of one another. The central or hand grip portion 14 is a cylinder of uniform diameter, and the two halves are provided with two pairs of confronting bosses 20 and 22, each having axial bores. Screws 24 and 26 extend through the bosses on the right half 16 and are threaded into the bosses 20 and 22 on the left hand to hold the halves of the trouble light together.

At the front end (the right end in the drawings) the trouble light is provided with a radially enlarged section 26 which is cylindrical in nature, and which is joined to the handle portion 14 by a tapered shoulder 26. At the front end of the enlarged section a right angled shoulder or flange 30 returns the trouble light to a projecting forward cylindrical portion 32 of the same diameter as the handle 14. A circumferential internal recess 34 in the enlarged portion 26 is disposed immediately adjacent the shoulder 30. Aligned apertures 36 are formed centrally in the enlarged portion 26, and are surrounded on the external surfaces by dimples 38.

An electrical socket and switch assembly 40 is shown in FIG. 5, and includes a cylindrical metallic open screw threaded sleeve 42 for receipt of a light bulb base to be screwed therein as needed. The sleeve or screw section or socket 42 is of conventional construction, and is secured by means such as screws or rivets to an insulating base 44 including and on-off switch operated by a switch operating cross member having cylindrical button portions 46 which extend through the holes 36, the dimples 38 providing finger access room for turning the light off and on. Electrical connectors 48 and 50 including screw fasteners are secured to the insulating base portion 44 and are internally connected to the screw threaded shell 42 and to a central contact (walls not shown, but of conventional nature). A third contact 52 is provided for a grounding wire 52.

A standard molded sleeve 54 is received over the threaded shell 42, the end 56 of the threaded shell or socket being substantially short of the outer end of the insulating sleeve 54 as an electrical safety measure. The sleeve 54 is secured to the threaded shell or socket 42 by having internal means for threading into the socket, or simply by being molded in the socket. The left or inner end of the sleeve is provided with an integral circumferential narrow flange 58 for receipt in the circumferential slot 34 to retain the sleeve, and hence the threaded shell in proper position. The outer end of the sleeve 54 is provided with a circumferential flange 60 which is of larger dimension, both axially and radially, as compared with the flange 58.

As may be seen in FIGS. 1 and 2 the flange 60 is spaced axially from the end 62 of the enlarged portion 26 to define an arcuate or circumferential groove 64, the base of which is the outer surface of the extending end portion 32. This arcuate groove forms a mounting section or base for the usual guard (not shown) for the light bulb. Such guard conventionally includes a reflector half to concentrate the light where wanted, and a lattice-like or mesh confronting portion guarding the light bulb against physical damage, but permitting light to shine forth.

The rear end of the trouble light is provided with a substantially cylindrical enlargement 66 joined to the handle 14 by a tapered shoulder 68. An inwardly directed circumferential flange 70 cooperates with the inner portion of the shoulder 68 and the rear end of the handle 14 to form an inwardly opening circumferential groove 72. On opposite sides, i.e., centrally disposed in the two halves 16 and 10 the enlargement is provided with rearwardly opening access slots 74 which are substantially V-shaped, but with rounded or somewhat less than semicircle spices 76, and rounder outer edges 78. An outwardly projecting axially elongated flange 80 encircles the outer end of the enlargement 66 and extends inwardly along the edge of each of the V shaped openings or slots 74. Two pairs of complimentary projections from the enlargement 66 cooperate to form a pair of buttons 82 joined to the enlarged portion 66 by studs 84, the buttons and studs comprising retainers as will be seen shortly.

A plug unit 86 (FIGS. 3 and 5) includes an insulating disk-like base 88 having a relatively small diameter portion 90 and a radially extending flange 92 integral therewith. As best may be seen in FIG. 3 the flange 92 is received in the groove 72 of the body shell with the inwardly directed flange 70 engaging the periphery of the smaller diameter portion 90 of the disk 88. A pair of flat electrical contact prongs 94 of conventional construction extend (to the left in the drawings) from the disk 86 and extend through the disk to electrical contacts 96. There is also a grounding prong 98 of U shape cross section mounted on the disk 88 and extending therethrough to an electrical contact 100. The three prongs 94 and 98 are of conventional construction. A pair of insulated electric wires 102 and 104 connect the connectors 96 respectively to the connectors 48 and 50 of the socket-switch arrangement 40, while a similar insulated electric wire 106 connects the grounding prong 98 connector 100 to the grounding connector 52 on the socket-switch unit. As will be understood the disk 86 and the socket-switch unit are assembled with one of the halves 16 and 18. The other half then is brought into engagement with the first half, and the screws 24 and 26 are threaded in to complete the construction of the trouble light.

Referring now to FIGS. 1 and 2, the trouble light is provided with a molded rubber retainer strap that is readily flexible, but only slightly stretchable. The strap is generally U-shaped, and is provided with a pair of legs 110 which are parallel to one another, and which have elongated slots 112 near the ends of the legs with circular openings 114 adjacent the centers of the slots and located in enlargements 116 of the strap legs. The interconnecting bight 118 of the strap is provided with an enlarged central circular portion 120 having a circular hole 122 in the center thereof connected by an edge opening slot 124 to the edge of the enlargement 120.

The trouble light 14 is assembled with a conventional grounded three wire extension cord 124 having a standard female socket 126 thereon by gripping the socket 126 in the fingers as shown with the phantom hand 128 in FIG. 1, and inserting it into the cavity formed by the enlargement 66. As will be seen this enlargement 66 acts as a prong guard to prevent accidental engagement of the fingers with the prongs when the female socket 126 is only partially associated with the prongs, whereby the prongs may be electrically live.

When the socket 126 has been fully inserted over the prongs into the recess formed by the prong guard 66 the retainer strap is associated with the socket and trouble light as shown FIGS. 1 and 2. Preferably, the openings 112, 114 of the retainer strap are associated with the retainers 82, 84, following which the slot 124 is passed over the extension cord 124 to anchor the extension cord in the opening 122. Preferably, the dimensions are such that the bight 118 abuts the rear end of the socket 126, whereby to secure the socket against accidental removal or partial retraction.

There are many advantages to having a separable extension cord rather than a permanent drop cord on the trouble light. An extension cord of suitable length may be chosen. For some uses, a relatively short extension cord is desirable, and it is not desired to have a long length of drop cord dangling where it may be in the way. For other uses a rather long extension cord may be desired or something of an inbetween length. In addition, if the trouble light should be damaged physically, or if it should simply be worn out, it can be replaced and the same extension cord or cords may be used. It will be appreciated, in commercial use, such as an automobile garage, there may be instances in which the work site may be at varying distances from an electrical outlet. Thus, a single trouble light may be used with a selection of extension cords of different length.

Figure 6:
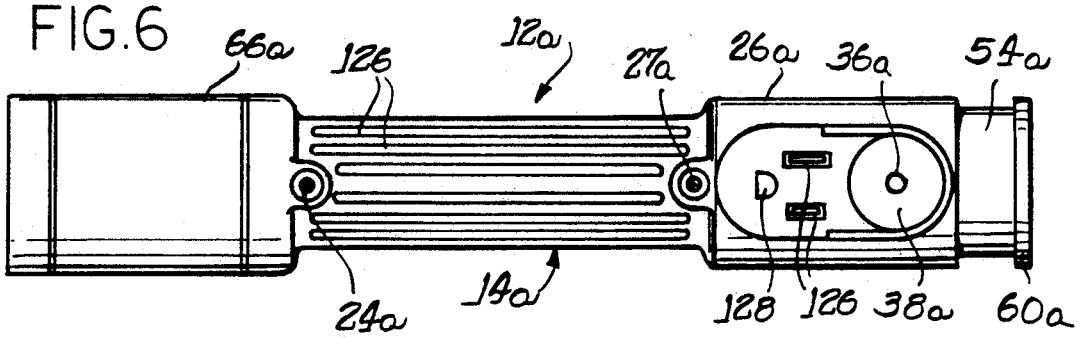
FIG. 6 is a side view of a modified form of the lamp housing.
Figure 7:
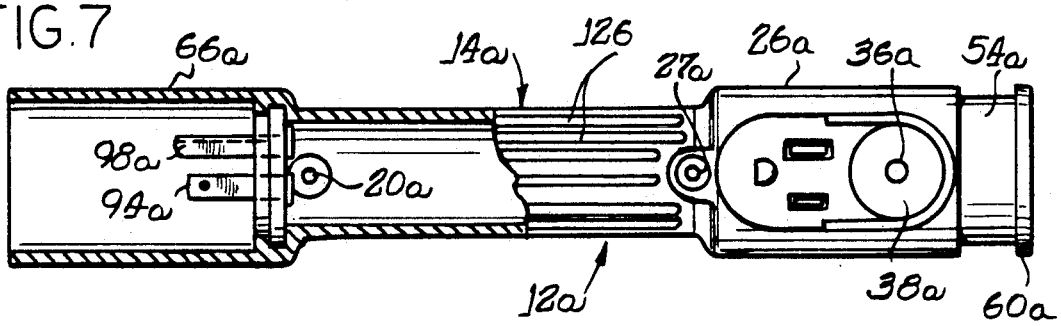
FIG. 7 is a view similar to FIG. 6 with a portion thereof broken away and shown in axial section.

A modification of the invention is shown in FIGS. 6 and 7. Most of the parts are as previously described, and similar parts are identified by like numerals with the additional of the suffix a. The handle **14*a* is provided with longitudinal grooves 126 for enhanced grippability. The right band enlargement 26*a* is longer to provide for a receptacle or socket for an extension cord, comprising a pair of flat receptacle openings 126, and a D-shaped opening 128 for receipt of a grounding prong. The electrical connections will be readily understood to those skilled in the art. The on-off pushbuttons 36*a* with the surrounding dimples 38*a*** are retained as in the previous form of the invention.

The prong guard **66*a* is elongated to be of substantially the same length as the enlargement 26*a* and molded plastic sleeve 54*a***, and yet devoid of the side recesses. This provides further electrical isolation and safety, and also provides a visual balance with the outer end of the trouble light.

Figure 8:
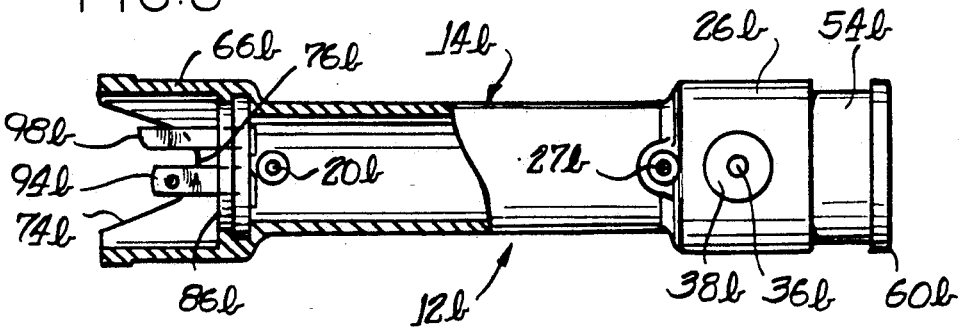
FIG. 8 is a view similar to FIG. 7 showing a further modification of the invention.
Figure 9:
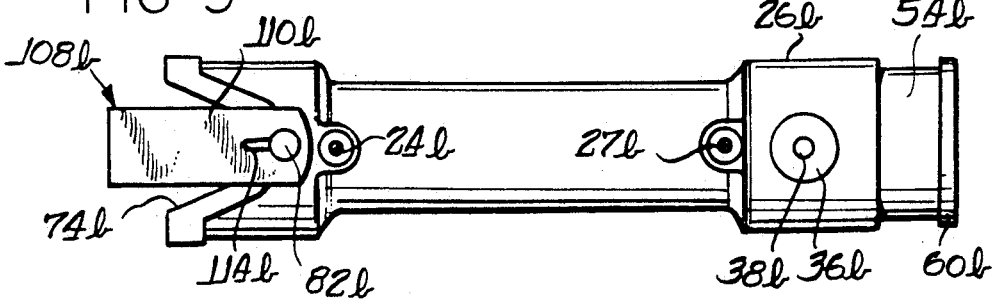
FIG. 9 is a side view corresponding to FIG. 8, and showing a retainer strap that also provides electrical safety.

Yet another modification of the invention is shown in FIGS. 8 and 9. This is nearly identical with the original showing, and similar parts again are identified with like numerals, this time with the addition of the suffix b. Significant distinction in the embodiment of FIGS. 8 and 9 is that the retainers comprising the buttons **82*b* and underlying (not shown) are moved 90° about the periphery of the trouble light, and the retainer strap 108*b* is wider so as largely to cover the V-shaped recesses or slots 74*b*, and thus completely to guard the prongs 94***b* and 98*b* if the extension cord should be forceably partially retracted, leaving the prongs not fully inserted in the socket.

It will now be apparent that I have fully disclosed a trouble light having a separable extension cord rather than the usual attached drop cord with many advantages including those heretofore enumerated. This specific embodiments of the invention as herein shown and described will be understood as being exemplary only. Changes will no doubt occur to those skilled in the art, and will be understood as forming a part of the present invention insofar as they fall within the spirit and scope of the appended claims.

The invention is claimed as follows:

1. A trouble light for use with an extension cord comprising an elongated housing of insulating material, an electric lamp socket within said housing and opening outwardly thereof for receipt of an electric light bulb, a standard set of male electrical contact prongs extending from a portion of said housing, a portion of said housing being spaced from said set of male electrical prongs and extending in the same direction as said prongs in shielding relation thereto, and electrical conducting means within said housing electrically interconnecting said set of prongs and said electric lamp socket, said shielding portion having recesses therein for finger and thumb access to an extension cord female socket temporarily associated with said set of prongs.

2. A trouble light for use with an extension cord comprising an elongated housing of insulating material, an electric lamp socket within said housing and opening outwardly thereof for receipt of an electric light bulb, a standard set of male electrical prongs extending from a portion of said housing, a portion of said housing being spaced from said set of male prongs and extending in the same direction as said prongs in shielding relation thereto, and electrical conducting means within said housing electrically interconnecting said set of prongs and said electric lamp socket, said trouble light further including retainer means on said trouble light engageable with an extension cord female socket to hold said female socket thereon in association with said prongs, and a pair of projections on said housing, said flexible retainer means extending between said projections, and an intermediate part of said retainer means being adapted to secure an extension cord female socket with said prongs inserted therein.

3. A trouble light as set forth in claim 2 wherein said retainer comprises a strap having a substantially keyhole-shaped opening laterally of said strap for association with an extension cord female socket.

4. A trouble light as set forth in claim 2 wherein the shielding portion has recesses therein for finger and thumb access to an extension cord female socket temporarily associated with said set of prongs.

5. A trouble light as set forth in claim 4 wherein said retainer comprises a strap having a substantially keyhole-shaped opening laterally of said strap for association with an extension cord female socket.

6. A trouble light as set forth in claim 2 wherein said projections comprise a pair of projections axially aligned with said recesses whereby said retainer substantially covers said recesses.

7. A trouble light as set forth in claim 2 wherein said housing comprises two elongated, substantially mirror halves, the retainer comprising complimentary halves each formed on one of the opposite halves of the housing.

* * * * *